US005638982A

United States Patent [19]

Spector

[11] Patent Number: 5,638,982

[45] Date of Patent: Jun. 17, 1997

[54] BALL-LIKE BEVERAGE CONTAINER

[76] Inventor: Donald Spector, 380 Mountain Rd., Union City, N.J. 07080

[21] Appl. No.: 722,673

[22] Filed: Sep. 30, 1996

[51] Int. Cl.[6] ..... B65D 85/34

[52] U.S. Cl. ..... 220/630; 220/666; 220/DIG. 13; 206/457; 206/822

[58] Field of Search ..... 220/630, 560, 220/666, DIG. 13; 206/457, 822

[56] References Cited

U.S. PATENT DOCUMENTS

| | | | |
|---|---|---|---|
| 464,121 | 12/1891 | Heineman | 206/822 |
| 1,388,094 | 8/1921 | Buttigieg | 220/822 |
| 3,418,139 | 12/1968 | Craig | 206/822 |
| 3,924,736 | 12/1975 | Bell et al. | 206/457 |
| 3,939,887 | 2/1976 | Scarnato | 220/666 |
| 4,356,915 | 11/1982 | Phillips | 206/822 |
| 4,600,102 | 7/1986 | Avila | 206/457 |
| 4,795,033 | 1/1989 | Duffy | 206/457 |
| 5,503,274 | 4/1996 | Toffler et al. | 206/457 |

*Primary Examiner*—Joseph M. Moy
*Attorney, Agent, or Firm*—Michael Ebert

[57] ABSTRACT

A container adapted to store a beverage and, when empty, to function as a playball. The container includes a spherical shell formed of a flexible synthetic plastic material having a tubular neck projecting therefrom on which is received a screw-on cap. The neck is retractable into the shell whereby the neck then assumes a re-entrant form and the cap is then frictionally held therein flush with the shell. In a storage mode of the container, the shell is filled with a beverage and is sealed by the flush cap. To switch to an active mode, the shell is squeezed and the resultant internal pressure produced by the beverage causes the cap to pop out and project the neck so that the cap can be unscrewed to dispense the beverage. In the play mode, the shell is empty and the air therein is sealed by the cap which is depressed to be again flush with the shell, the container now being a pneumatic play ball.

9 Claims, 1 Drawing Sheet

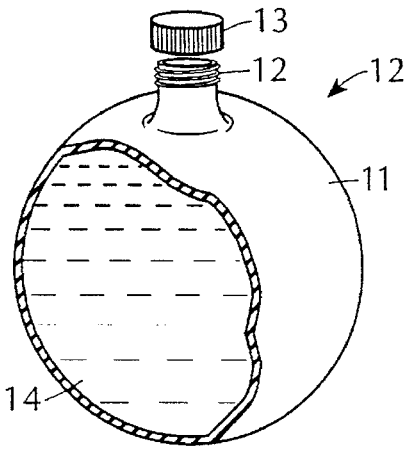
FIG. 1
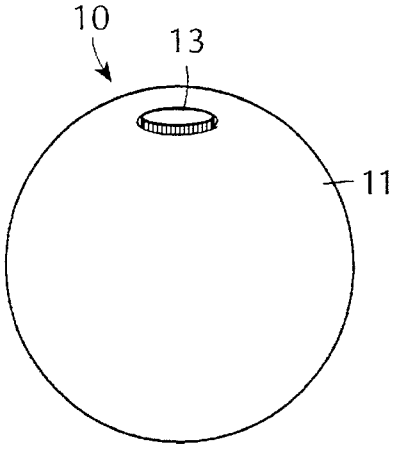
FIG. 2
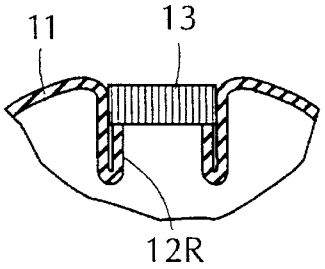
FIG. 3
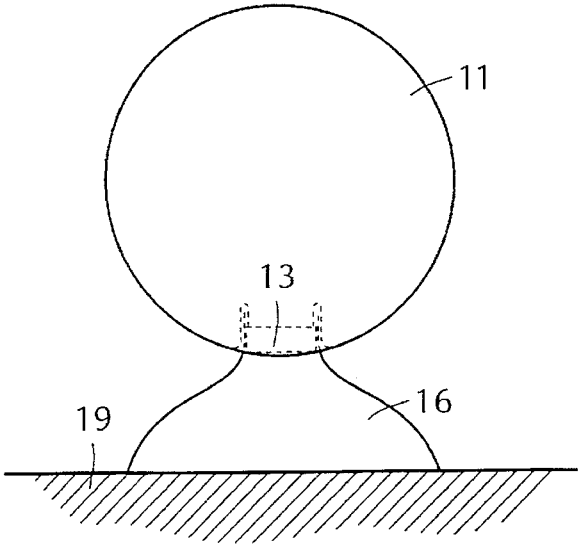
FIG. 5
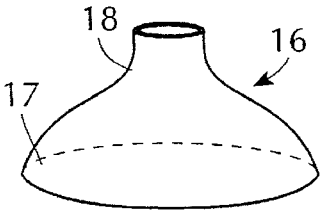
FIG. 4
FIG. 6
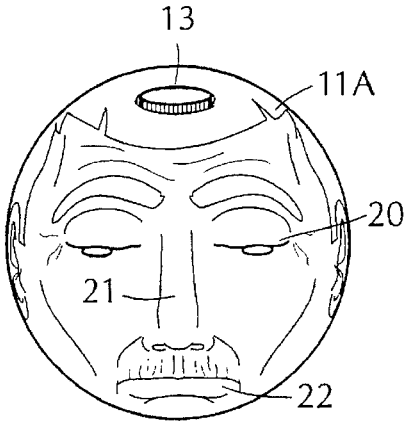

BALL-LIKE BEVERAGE CONTAINER

BACKGROUND OF INVENTION

1. Field of Invention

This invention relates generally to beverage containers, and more particularly to a container which normally functions to store a beverage and when empty is then capable of functioning as a play ball.

2. Status of Prior Art

The term beverage, as broadly used herein, includes spring water, juices, sodas and all other drinkable liquids which are normally stored in bottles.

It is now the common practice to bottle mineral water and other beverages in cylindrical containers formed of polyethylene or other liquid-impermeable synthetic plastic film material non-reactive with the beverage stored therein. These plastic bottles include an externally-threaded tubular neck on which is received a screw-on cap that seals the contents.

Because a cylindrical bottle has a flat base, it can be placed on a shelf or table without the need for a support. When a plastic bottle of this type is emptied, it has no further use and is therefore discarded or recycled. And since conventional plastic beverage bottles are devoid of ornament and are purely functional, they are never collected as ornamental or artistic objects.

A conventional playball has a relatively thick rubber casing filled with air to impart pneumatic characteristics to the ball so that it will bounce. As shown in the Casey U.S. Pat. No. 2,324,277 it is known to mold such a rubber ball so as to impart to its outer surface the facial features of a human or animal head, these being defined by shaped recesses in the irregular outer surface.

Rubber balls in large sizes are relatively heavy and difficult for small children to handle. Hence a spherical beach ball whose diameter is about the same as that of a soccer ball is usually fabricated of thin-walled synthetic plastic film material and therefore light in weight.

But plastic bottles for beverages of the type heretofore known are incapable of functioning as playballs, and playballs of the type heretofore known are incapable of functioning as beverage containers.

SUMMARY OF INVENTION

In view of the foregoing, the main object of this invention is to provide a plastic container adapted to store a beverage, and when empty, to function as a playball so that there is never any occasion to discard the container.

More particularly, an object of this invention is to provide a container of the above type having a spherical shell formed of synthetic plastic film material, which container normally acts to store a beverage, and when empty, functions as a spherical playball.

A significant feature of a container in accordance with the invention is the that spherical plastic shell is so molded that its outer surface is recessed to define a humanoid or animal like head, or to create a decorative pattern, whereby the container has an ornamental or artistic form that is appealing to collectors. Thus containers for different types of beverages may be molded so that they each have a distinctive appearance, thereby making available a range of collectable items.

Also an object of this invention is to provide a stand which when coupled to the spherical shell of the container makes it possible to place the container on a shelf, a table or other horizontal surface, the stand then maintaining the container at a stable position so that it does not roll.

Briefly stated, these objects are attained by a container adapted to store a beverage and, when empty, to function as a playball. The container includes a spherical shell formed of a flexible synthetic plastic material having a tubular neck projecting therefrom on which is received a screw-on cap. The neck is retractable into the shell whereby the neck then assumes a re-entrant from and the cap is then frictionally held therein flush with the shell.

In a storage mode of the container, the shell is filled with a beverage and is sealed by the flush cap. To switch to an active mode, the shell is squeezed and the resultant internal pressure produced by the beverage causes the cap to pop out to project the neck so that the cap can be unscrewed to dispense the beverage. In the play mode, the shell is depressed empty and the air therein is sealed by the cap which is to be again flush with the shell, the container now being a pneumatic play ball.

BRIEF DESCRIPTION OF DRAWINGS

For a better understanding of the invention, as well as other objects and further features thereof, reference is made to the following detailed description to be read in conjunction with the accompanying drawings, wherein:

FIG. 1 is a perspective view of a container in accordance with the invention in which the spherical plastic shell of the container is filled with a beverage, the shell being cut away to expose the beverage;

FIG. 2 is the same as FIG. 1, except that the neck of the shell to which a cap is coupled is retracted so that the cap is then flush with the shell and the container is then in a storage mode;

FIG. 3 is a sectional view of the retracted neck;

FIG. 4 illustrates a stand which when coupled to the neck of the container serves to support the container on a horizontal surface;

FIG. 5 shows the container supported by the stand on a horizontal surface; and FIG. 6 shows another embodiment of the container in which the shell is molded to impart an ornamental or artistic appearance thereto.

DESCRIPTION OF INVENTION

The Container

A container in accordance with the invention, generally designated by numeral 10 in FIG. 1, includes a spherical shell 11. Shell 11 is formed of a thin-walled, flexible synthetic plastic material, such as polypropylene or polyethylene. This material is impermeable to liquids and non-reactive with the beverage stored in the container.

Spherical shell 11 is provided with a tubular neck 12 of the same flexible material as that of the shell. Neck 12 is externally-threaded and normally projects from the shell in axial alignment with the diameter of the shell. Received on the threaded end of neck 12 is a screw-on cap 13. The side wall of cap 13 is preferably knurled so that the cap can be grasped by the fingers and easily turned to tighten the cap on the neck or to unscrew it.

When container 10 functions to store a beverage, shell 11 is then filled with the beverage 14 which is sealed by cap 13. An elastomeric sealing washer is seated within the cap (not shown) at the underside of the end wall of the cap whereby when the cap is tightened on the neck, the washer is compressed to seal the liquid contents of the container.

In the storage mode of container 10 as illustrated in FIG. 2, cap 13 is pushed in to cause neck 12 to retract into the shell. When neck 12 is retracted, it then assumes as shown in FIG. 3 a re-entrant form 12R, with cap 13 frictionally held therein so that it lies flush with shell 11 and resists projection of the neck from the shell.

When a user wishes to dispense the beverage, the user squeezes container 10 to switch it from the storage mode shown in FIG. 2 to an active mode. The resultant internal pressure produced by the incompressible liquid is applied to cap 13, causing the cap to pop out and in doing so to project the neck 12. The container the assumes the active mode form shown in FIG. 1. In this active mode, the user can unscrew cap 13 and then pour the beverage from the neck. The user can, of course, drink directly from the neck.

When shell 11 is empty the container is not then discarded, but is converted into a play mode to function as a playball. To put the empty container in a play mode, cap 13 is screwed back onto the projecting neck 12 to hermetically seal the air in the shell. Cap 13 is then pushed in to cause the neck to retract into the shell so that the cap is then flush with the shell. This action subjects the air confined within the shell to internal pressure somewhat above atmospheric.

Hence container 10 is now a spherical pneumatic play ball which is relatively light in weight. Should the player wish to have a somewhat heavier playball, before screwing the cap onto the neck, he has only to add some water to the shell, the weight of the resultant ball depending on the amount of water added thereto.

The size of the spherical playball depends on the beverage capacity of the container. Standard beverage bottles have different capacities, such as a quarter liter, a half liter, a full liter, or a liter and a half. Thus a spherical container 10 having a one 1.5 liter capacity will in a play mode provide a plastic ball having a relatively large diameter suitable as a beach ball. Containers having smaller capacity will produce balls of small diameter.

One great advantage of beverage containers in accordance with the invention is that it makes it possible for a family to take these containers to the beach or a play field to supply beverages to the family and when the containers are empty to provide the family with playballs.

To prevent the caps from accidentally popping out when the beverage-filled containers are in a storage mode, use may be made of a small sticker formed by a die-cut sheet having a pressure-sensitive adhesive coated on its undersurface. The sticker is applied onto the spherical shell so that it overlies the flush cap and prevents the cap from popping out even if pressure is accidentally applied to the shell. The sticker is peeled off before the container is converted to its active mode.

The Container Stand

A beverage-filled spherical container 10 as shown in FIG. 2 in the storage mode cannot be placed on a shelf or table, for it is likely to roll off the horizontal surface.

In order therefore to make it possible to place the container on a horizontal surface, a hollow stand 16 is provided, as shown in FIG. 4. Stand 16 is molded of relatively rigid synthetic plastic material, such as PVC having a frustoconical shape defining a circular base 17 of relatively large diameter and an upper collar 18 which is adapted to be received over neck 12 of the container and to be clamped between the neck and the cap 13 screwed thereon. Hence when the cap is pushed in to lie flush with the spherical shell, the stand which now projects from the container as shown in FIG. 5, can serve to support the container on a shelf or any other horizontal surface on which the container is rested. Stand 16 therefore provides a stable support for the spherical container and prevents it from rolling.

When the stand-supported, beverage-filled container is to be put to use to dispense the beverage, the user squeezes the shell to pop out the cap and the stand coupled thereto. Since the stand is hollow, the user now has access to the cap which can then be unscrewed.

Once the cap is unscrewed, the stand is discarded, but not the cap. After the beverage is dispensed from the container, the cap is screwed back on the neck to convert the empty container to a play ball.

Modified Container

In order to provide a beverage container that is ornamental, the spherical plastic shell 11A of the container shown in FIG. 6 may be molded under pressure in a mold cavity to impress in its outer surface irregular and relatively shallow recesses defining the eyes 20, nose 21, mouth 22 and other facial features of a humanoid or animal-like head. The head may be appropriately colored.

Or the molding may be such as to impress on the outer surface of the shell decorative patterns which impart an ornamental appearance to the shell. Thus the resultant beverage container is not purely functional, but may be displayed like a Toby mug, a German beer mug or other beverage container that has an artistic or ornamental form. Hence containers in this form can become collectors' items. When the container having the appearance of a humanoid head is converted into a play ball, then the player will effectively be bouncing or tossing a fanciful head, the larger the ball the more realistic the head. Because the outer surface of the molded shell is irregular, it gives the player a better grip on the ball.

While there have been shown preferred embodiments of the ball-like beverage container in accordance with the invention, it will be appreciated that many changes may be made therein without departing from the spirit of the invention.

I claim:

1. A container adapted to store a drinkable liquid and, when empty, to function as a play ball, the container comprising:

(a) a spherical shell formed of synthetic plastic flexible material having a tubular neck normally projecting therefrom that is retractable into the shell to assume a re-entrant form;

(b) aa removable cap coupled to the neck which when pushed in is frictionally engages by the re-entrant neck and is flush with the shell, said container in a storage mode being filled with said liquid and being sealed by the cap which is then flush with the shell, said container being convertible to an active mode by squeezing the shell to produce an internal liquid pressure causing said cap to pop out to project the neck so that can be removed to dispense the liquid, said container when empty being convertible to a play mode by recoupling the cap to the neck to seal the air in the container and depressing the cap so that it is again flush with shell to create a pneumatic play ball.

2. A container as set forth in claim 1, in which the plastic material is polyethylene.

3. A container as set forth in claim 1, in which the plastic material is polypropylene.

4. A container as set forth in claim 1, in which the liquid is spring water.

5. A container as set forth in claim 1, in which the liquid is a flavored beverage.

6. A container as set forth in claim 1, in which the spherical shell is molded so that its outer surface is recessed to assume an ornamental appearance.

7. A container as set forth in claim 6, in which the ornamental appearance is defined by facial features of a humanoid or animal-like head.

8. A container as set forth in claim 1, further including a removable stand coupled to the neck of the shell and clamped thereto by the cap to support the container on a horizontal surface.

9. A container as set forth in claim 8, in which the stand has a frusto-conical hollow form defining a large diameter base and an upper collar having a smaller diameter that fits over the neck.

* * * * *